US011560640B2

(12) United States Patent
Okamachi et al.

(10) Patent No.: US 11,560,640 B2
(45) Date of Patent: Jan. 24, 2023

(54) FILLING PLATING SYSTEM AND FILLING PLATING METHOD

(71) Applicant: C. Uyemura & Co., Ltd., Osaka (JP)

(72) Inventors: Takuya Okamachi, Osaka (JP); Naoyuki Omura, Osaka (JP); Kanako Matsuda, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 221 days.

(21) Appl. No.: 15/854,537

(22) Filed: Dec. 26, 2017

(65) Prior Publication Data

US 2018/0195193 A1 Jul. 12, 2018

(30) Foreign Application Priority Data

Jan. 12, 2017 (JP) ..... P2017-003286

(51) Int. Cl.

| | |
|---|---|
| ***C25D 17/00*** | (2006.01) |
| ***C25D 5/34*** | (2006.01) |
| ***C25D 7/00*** | (2006.01) |
| ***C25D 21/14*** | (2006.01) |
| *C25D 3/38* | (2006.01) |
| *C25D 5/02* | (2006.01) |

(52) U.S. Cl.

CPC ..... *C25D 5/34* (2013.01); *C25D 7/00* (2013.01); *C25D 17/00* (2013.01); *C25D 21/14* (2013.01); *C25D 3/38* (2013.01); *C25D 5/02* (2013.01)

(58) Field of Classification Search

None

See application file for complete search history.

(56) References Cited

U.S. PATENT DOCUMENTS

| | | | | |
|---|---|---|---|---|
| 3,535,222 | A * | 10/1970 | Paul | C25D 11/04 204/207 |
| 4,519,878 | A * | 5/1985 | Hara | C25D 3/562 205/141 |
| 6,123,824 | A * | 9/2000 | Sano | C25D 9/08 205/124 |
| 6,638,411 | B1 * | 10/2003 | Mishima | C25D 5/18 118/73 |

(Continued)

FOREIGN PATENT DOCUMENTS

| | | |
|---|---|---|
| JP | 200657177 | 3/2006 |
| JP | 2007138265 | 6/2007 |

(Continued)

*Primary Examiner* — Stefanie S Wittenberg

(74) *Attorney, Agent, or Firm* — Haverstock & Owens, A Law Corporation

(57) ABSTRACT

The purpose of the present invention is to provide a filling plating system and a filling plating method capable of filling plating sufficiently even if the plating is interrupted between electrolytic plating cells. A filling plating system for forming filling plating in a via hole and/or a through hole of a work to be plated, comprising: a plurality of electrolytic plating cells; and an additive adhesion region arranged between each of the plurality of electrolytic plating cells, wherein solution containing one or more kinds of additive selected from at least a leveler comprising nitrogen-containing organic compound, a brightener comprising sulfur-containing organic compound, and a carrier comprising polyether compound, is directly adhered to the work to be plated at the additive adhesion region.

5 Claims, 4 Drawing Sheets

(56) References Cited

U.S. PATENT DOCUMENTS

| | | | | |
|---|---|---|---|---|
| 2003/0141195 | A1* | 7/2003 | Brodt | C25D 3/565<br>205/244 |
| 2004/0040865 | A1* | 3/2004 | Matzka | C25F 7/00<br>205/705 |
| 2009/0065365 | A1* | 3/2009 | Durmus | C25D 3/38<br>205/183 |
| 2009/0188805 | A1* | 7/2009 | Moffat | C25D 7/123<br>205/119 |
| 2012/0219844 | A1* | 8/2012 | Tsutsumi | H01G 11/06<br>429/153 |
| 2015/0259814 | A1* | 9/2015 | Luo | C25D 3/38<br>205/296 |

FOREIGN PATENT DOCUMENTS

| | | | | |
|---|---|---|---|---|
| KR | 20130075060 | * | 7/2013 | C25D 1/04 |
| KR | 20130124656 | * | 11/2013 | C25D 17/00 |

* cited by examiner

FILLING PLATING SYSTEM AND FILLING PLATING METHOD

BACKGROUND OF THE INVENTION

Field of the Invention

The present invention relates to a filling plating system and a filling plating method for forming filling plating in a via hole and/or a through hole of a work to be plated. The present application claims priority based on Japanese Patent Application No. 2017-003286 filed in Japan on Jan. 12, 2017, which is incorporated by reference herein.

Description of Related Art

Filling plating is used mainly when filling laser via hole or through hole with plating. Via on via or pad on via becomes possible by via hole filling plating. In addition, it is possible to reduce a number of processes by through hole filling plating. Further, a breakage caused by plating fracture in the via hole and in the through hole resulting from heat stress or the like tends not to occur, and improvement of reliability can be expected.

Mainly additives of a brightener, a leveler, and a carrier are added as additive of plating bath used in filling plating.

In Patent Literature 1, as a method for electrolytic copper plating for via hole filling plating, it is described to perform via filling plating by containing a water-soluble copper salt, sulfuric acid, chlorine ion, a brightener, a carrier and a leveler of nitrogen ring compound.

In addition, in Patent Literature 2, an electrolytic copper plating bath containing a water soluble copper salt, sulfuric acid, chlorine ion, and a brightener, a carrier and a leveler as additives, wherein the leveler contains one or more kinds of water soluble polymers containing quaternary nitrogen, tertiary nitrogen or both quaternary nitrogen and tertiary nitrogen which are cationized in a solution, is described.

Patent Literature 1: JP 2006-057177 A

Patent Literature 2: JP 2007-138265 A

SUMMARY OF THE INVENTION

However, depth and size of a diameter of the via hole, or depth and size of a diameter of the through hole varies by a purpose, so there is a case that filling plating is performed by separating the plating condition in some electrolytic plating cells, in order to fill the via hole or the through hole completely. In addition, from a point of view of productivity and relation of installation site and size of facility, there is a case that filling plating is performed by providing a plurality of electrolytic plating cells. In such case, the plating is interrupted between the electrolytic plating cells, and there is a possibility that filling of plating into the via hole or the through hole becomes insufficient.

Therefore, the purpose of the present invention is to provide a filling plating system and a filling plating method capable of filling plating sufficiently even if the plating is interrupted between electrolytic plating cells.

A filling plating system according to one embodiment of the present invention is a filling plating system for forming filling plating in a via hole and/or a through hole of a work to be plated, comprising: a plurality of electrolytic plating cells; and an additive adhesion region arranged between each of the plurality of electrolytic plating cells, wherein solution containing one or more kinds of additive selected from at least a leveler comprising nitrogen-containing organic compound, a brightener comprising sulfur-containing organic compound, and a carrier comprising polyether compound, is directly adhered to the work to be plated at the additive adhesion region.

In this way, it is possible to inhibit a decline of filling performance, and to maintain high filling property, even when the plating is interrupted between the electrolytic plating cells.

At this time, in one embodiment of the present invention, the additive may comprise the leveler and the brightener or the carrier.

In this way, it is possible to inhibit a decline of filling performance further, as the leveler is contained.

At this time, in one embodiment of the present invention, the additive may not comprise the brightener and the carrier.

In this way, it is possible to inhibit a decline of filling performance further, and to maintain high filling property, and also, it is also advantageous in cost.

At this time, in one embodiment of the present invention, solution containing the additive may be directly adhered to the work to be plated in non-energized state at the additive adhesion region.

In this way, it is possible to inhibit a decline of filling performance, as additive molecules tend to adsorb on a surface of the work to be plated.

In addition, in one embodiment of the present invention, the additive may be having same component as additives in the plurality of electrolytic plating cells.

In this way, it will be operationally advantageous in cost, in operation, and in management.

In addition, in one embodiment of the present invention, concentration of the additive may be same as concentration of additives in the plurality of electrolytic plating cells.

In this way, it will be operationally more advantageous in cost, in operation, and in management.

In addition, in one embodiment of the present invention, the plurality of electrolytic plating cells may be devices to perform plating while carrying the work to be plated horizontally or vertically.

In this way, it will be applicable to a horizontal device or a vertical device in which the plating may be interrupted.

In addition, in other embodiment of the present invention, it is a filling plating method for forming filling plating in a via hole and/or a through hole of a work to be plated, wherein, while plating with a plurality of electrolytic plating cells, one or more kinds of additive selected from at least a leveler comprising nitrogen-containing organic compound, a brightener comprising sulfur-containing organic compound, and a carrier comprising polyether compound, is directly adhered to the work to be plated at an additive adhesion region.

In this way, it is possible to inhibit a decline of filling performance, and to maintain high filling property, even when the plating is interrupted between the electrolytic plating cells.

As explained in the above, according to the present invention, it is possible to inhibit a decline of filling performance, and to maintain high filling property, even when the plating is interrupted between the electrolytic plating cells.

DETAILED DESCRIPTION OF THE INVENTION

Hereinafter, explaining in detail about preferred embodiments of the present invention. In addition, the embodiments explained in below will not unjustly limit the content of the present invention described in claims, and it is not limited that all the structures explained in the embodiments are necessary as means for solving the problem of the present invention.

Figure 1:
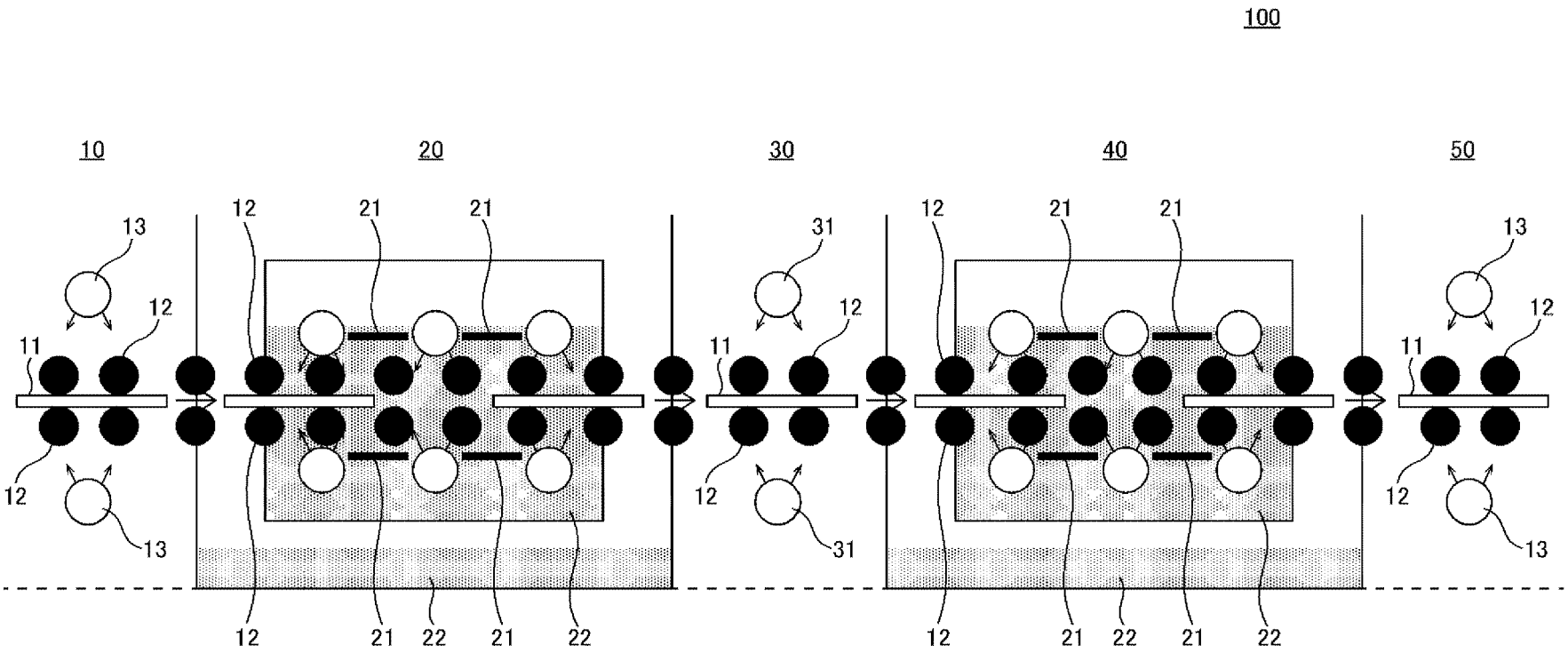
FIG. 1 is a view illustrating a schematic structure of a filling plating system relating to one embodiment of the present invention.

At first, explaining about a structure of a filling plating system relating to one embodiment of the present invention, using the drawings. FIG. 1 is a view illustrating a schematic structure of a filling plating system relating to one embodiment of the present invention.

A filling plating system 100 relating to one embodiment of the present invention is a filling plating system capable of filling plating sufficiently even if the plating is interrupted between electrolytic plating cells. As illustrated in FIG. 1, the filling plating system 100 of the present embodiment comprises an electrolytic plating cell 20, an additive adhesion region 30, and an electrolytic plating cell 40. In addition, a pre-treatment cell 10 may be provided before the electrolytic plating cell 20, and a post-treatment cell 50 may be provided after the electrolytic plating cell 40. And a work to be plated is carried in constant speed to the pre-treatment cell 10, the electrolytic plating cell 20, the additive adhesion region 30, the electrolytic plating cell 40, and to the post-treatment cell 50.

The pre-treatment cell 10 before the electrolytic plating cell 20 is a cell for performing necessary pre-treatment before electrolytic plating. For example, chemical copper plating is performed, in order to apply conductivity in a via hole or a through hole of a work 11 to be plated. Then, sulfuric acid treatment may be performed. When conductivity is already applied, pre-treatment before plating is performed with sulfuric acid or the like.

At the pre-treatment cell 10, the work 11 to be plated is carried by carrying rollers 12. At that time, a treatment is performed by adhering drug solution for performing the necessary treatment by spray nozzles 13, and the work 11 to be plated is carried to the next electrolytic plating cell 20.

And, at the electrolytic plating cell 20, filling plating is formed in the via hole or the through hole of the work 11 to be plated. The electrolytic plating cell 20 performs plating by electrolytic plating, so in a case of a device for performing plating while carrying the work 11 to be plated horizontally, for example as described in FIG. 1, anodes 21 are provided in horizontal direction at top direction and at bottom direction of the work 11 to be plated in the cell.

In addition, in the electrolytic plating cell 20, initial make up of electrolytic bath is prepared with plating solution 22 for forming filling plating to the via hole or the through hole. As an additive of filling plating solution 22, a leveler, a brightener, and a carrier are mainly added, and filling plating is formed by a function of the additive. And, after treatment at the electrolytic plating cell 20, the work 11 to be plated is carried to the additive adhesion region 30.

The additive adhesion region 30 is provided between the above electrolytic plating cell 20 and the following electrolytic plating cell 40. And, one or more kinds of additive selected from at least a leveler comprising nitrogen-containing organic compound, a brightener comprising sulfur-containing organic compound, and a carrier comprising polyether compound, is directly adhered to the work to be plated at the additive adhesion region 30 by additive adhesion nozzles 31 or the like.

In this way, it is possible to inhibit a decline of filling performance, and to maintain high filling property, even when the plating is interrupted between the electrolytic plating cells. The detail will be discussed later.

After treatment at the additive adhesion region 30, the work 11 to be plated is carried to the electrolytic plating cell 40. At the electrolytic plating cell 40, filling plating is performed further, and inside of the via hole or the through hole will be filled with plating.

After performing filling plating at the electrolytic plating cell 40, the work 11 to be plated is carried to the post-treatment cell 50. At the post-treatment cell 50, necessary post-treatment, for example rust preventive treatment, water washing, drying or the like, is performed.

Here, from specification or facility condition of the work to be plated, there is a case that filling plating is performed by separating into some electrolytic plating cells. In such case, plating is interrupted once between the cells, and there is a case that filling of plating into the via hole or the through hole becomes insufficient.

As an example that plating is interrupted, there is a case that electrolytic plating is performed by separating plating condition into some plating conditions, in order to correspond to product specification such as depth and size of a diameter of the via hole, or depth and size of a diameter of the through hole. For example, there is a case that it is plated for example in a condition of low copper concentration for focusing on throwing power of plating in the via hole or the through hole at first electrolytic plating cell, and that it is plated for example in a condition of high copper concentration for focusing on filling performance at latter electrolytic plating cell. At that time, plating is interrupted.

Further, when plating is performed while carrying the work 11 to be plated horizontally as described in FIG. 1, gas such as oxygen generated from the anodes 21 tends to accumulate at lower surface of the work 11 to be plated, so plating performance tends to decline compared to upper surface of the work 11 to be plated. Therefore, there is a case that electrolytic plating cell is separated into a plurality of cells, and that a mechanism to exchange upper and lower surfaces of the work to be plated per cell is provided, and at that time, plating is interrupted.

In addition, when electrolytic plating is performed by pulse plating, appearance of the work to be plated tends to be deteriorated. Therefore, after plating with electrolytic plating cell of pulse plating, there is a case that it is plated with other electrolytic plating cell with direct current. At that time, plating is interrupted.

Further, in a device of roll to roll, it is separated into a plurality of electrolytic plating cells for providing power feeding roller. Therefore, between a cell and a cell with power feeding roller, a site exists where plating reaction is interrupted as the work to be plated goes out from plating solution. At that time, plating is interrupted.

In addition, in a case of pattern plating, there is an influence of dry film residue, so there is a case that it is plated with plating bath with excellent covering capable of corresponding to low current density in the initial stage of plating, and then, it is plated with plating bath corresponding to high current density for improving the productivity. At that time, plating is interrupted.

Therefore, in the filling plating system relating to one embodiment of the present invention, it is possible to inhibit a decline of filling performance, and to maintain high filling property, even when the plating is interrupted, by directly adhering one or more kinds of additive selected from at least a leveler comprising nitrogen-containing organic compound, a brightener comprising sulfur-containing organic compound, and a carrier comprising polyether compound, to the work to be plated.

As mentioned above, the additive is directly adhered to the work to be plated. For example, the additive is directly adhered to the work to be plated, and not by adhering the additive to the carrying rollers 12, the power feeding roller and else and transferring the additive to the work to be plated. If the additive is adhered to the carrying rollers 12, the power feeding roller and else, it is not clear whether the additive is sufficiently adhered to the work to be plated or not, and if the additive is continuously adhered to the carrying rollers 12 or the power feeding roller, solution containing the additive will be crystallized and fixed to the rollers soon, and the rollers will not be able to contact to the work to be plated uniformly, so adhesion of the additive to the work to be plated becomes difficult. In addition, if the additive is adhered to the power feeding roller, the roller is in a state of power feeding, so a state of molecules of the additive will be transformed, and there is a case that an ability to adsorb to a surface of the work to be plated will be declined. Further, in some cases, when the additive is adhered to the power feeding roller, there is a case that additive component will be decomposed, and there is a case that it will be difficult to adsorb additive molecules to a surface of the work to be plated in a state that they exert their function sufficiently. Therefore, in the filling plating system relating to one embodiment of the present invention, the additive is directly adhered to the work to be plated. In this way, it is possible to inhibit a decline of filling performance, and to maintain high filling property.

Further, in the filling plating system relating to one embodiment of the present invention, it is preferable to directly adhere the additive to the work to be plated in non-energized state. When the additive is directly adhered to the work to be plated in energized state, it will be difficult for the additive to adsorb to a surface of the work to be plated as the work to be plated is negatively charged, and there is a case that it will not be possible to inhibit a decline of filling performance sufficiently. Here, in the filling plating system relating to one embodiment of the present invention, a decline of filling performance is inhibited further, by adhering the additive to the work to be plated in non-energized state to facilitate adsorption of the additive molecules on a surface of the work to be plated. Especially, molecules of the leveler are charged with cationy, so they tend to adsorb to a surface of the work to be plated better in non-energized state, so it will be advantageous in inhibition of a decline of filling performance.

In addition, two electrolytic plating cells and one additive adhesion region are described in FIG. 1, but according to the above specification and conditions, three or more electrolytic plating cells and two or more additive adhesion regions between each of the electrolytic plating cells may be provided. There is a case that it is advantageous to provide three or more electrolytic plating cells and two or more additive adhesion regions between each of the electrolytic plating cells, from a point of view of improvement of productivity.

Further, a number of interruptions of plating depend on a number of the electrolytic plating cells, and filling performance will be decreased as a number of interruptions are increased. Here, by using the filling plating system relating to one embodiment of the present invention, it is possible to inhibit a decline of filling performance, and to maintain high filling property. Therefore, as a number of interruptions increase, an effect of the filling plating system relating to one embodiment of the present invention will be more advantageous.

The filling plating system relating to the present embodiment directly adheres one or more kinds of additive selected from at least a leveler, a brightener and a carrier, at additive adhesion region provided between the electrolytic plating cells. A decline of filling performance cannot be inhibited, even if the filling plating is performed to the via hole or the through hole by adhering the additive before the first electrolytic plating cell, and not when the plating is interrupted as the above. Therefore, it is important to adhere the additive between the electrolytic plating cells.

The additive adhered at the additive adhesion region 30 is one or more kinds of additive selected from at least a leveler comprising nitrogen-containing organic compound, a brightener comprising sulfur-containing organic compound, and a carrier comprising polyether compound, and solution containing the additive is directly adhered to the work to be plated.

At first, the leveler may be nitrogen-containing organic compound. Concretely, polyethylenimine and its derivative, polyvinylimidazole and its derivative, polyvinylalkylimidazole and its derivative, vinylpyrrolidone and vinylalkylimidazole and its derivative, a dye such as Janus green B, diaryl dimethyl ammonium chloride polymer, diaryl dimethyl ammonium chloride-sulfur dioxide copolymer, part 3-chloro-2-hydroxy propylated diarylamine hydrochloride-diaryl dimethyl ammonium chloride copolymer, diaryl dimethyl ammonium chloride-acrylamide copolymer, diarylamine hydrochloride-sulfur dioxide copolymer, arylamine hydrochloride polymer, arylamine (free) polymer, arylamine hydrochloride-diarylamine hydrochloride copolymer, diamine and epoxy polymer, morpholine and epichlorohydrin polymer, denatured epichlorohydrin polycondensate consists of diethylenetriamine, adipic acid and ε-caprolactam, can be cited, but it is not limited to the compounds cited in this concrete examples.

The brightener may be sulfur-containing organic compound. Concretely, sulfur-containing organic compound as indicated below can be cited, but it is not limited to the compounds cited in this concrete examples.

$$R1—S—(CH_2)_n—(O)_p—SO_3M \quad (1)$$

$$(R2)_2N—CSS—(CH_2)_n—(CHOH)_p—(CH_2)_n—(O)_p—SO_3M \quad (2)$$

$$R2—O—CSS—(CH_2)_n—(CHOH)_p—(CH_2)_n—(O)_p—SO_3M \quad (3)$$

(In a formula, R1 is hydrogen atom, or a group indicated by $—(S)_m—(CH_2)_n—(O)_p—SO_3M$, R2 is alkyl group of carbon number 1 to 5 and respectively independent, M is hydrogen atom or alkali metal, m is 0 or 1, n is an integer of 1 to 8, p is 0 or 1.)

The carrier may be polyether compound. Concretely, polyether compound comprising polyalkylene glycol containing four or more —O— can be cited, more concretely, polyethylene glycol, polypropylene glycol and these copolymer, polyethylene glycol fatty acid ester, polyethylene glycol alkyl ether, and else can be cited, but it is not limited to the compounds cited in this concrete examples.

In addition, the additive preferably comprises the leveler and the brightener or the carrier. It is possible to inhibit a decline of filling performance further, by adding the leveler.

Further, it is more preferable that the additive adhered at the additive adhesion region 30 is the additive, which does not comprise the brightener and the carrier. In other words, it is preferable to adhere the additive comprising the leveler only or the leveler and an additive other than the brightener and the carrier, or an additive containing sulfuric acid, hydrochloric acid, or surfactant. Especially, as leveler additive of nitrogen-containing organic compound is strong at adsorption to a surface compared to the brightener and the carrier as it is charged with cationy, and as the leveler additive can easily adsorb to the surface without competitive adsorption to the surface with the brightener and the carrier, if it is configured to be the additive, which does not comprise the brightener and the carrier.

In addition, other than the leveler, the brightener and the carrier, for example sulfuric acid or hydrochloric acid, organic acid such as acetic acid or formic acid, surfactant, and else can be comprised as solution relating to one embodiment of the present invention, and can be adhered to the work to be plated.

Component of the additive is preferably same as component of additives in the electrolytic plating cells 20 and 40. For example, if Janus green B is used as leveler additive in the electrolytic plating cells 20 and 40, Janus green B is also used as the additive adhered at the additive adhesion region 30. In addition, if bis-(3-sodium sulfopropyl) disulfide is used as brightener additive in the electrolytic plating cells 20 and 40, bis-(3-sodium sulfopropyl) disulfide is also used as the additive adhered at the additive adhesion region 30. Further, if polyethylene glycol is used as carrier additive in the electrolytic plating cells 20 and 40, polyethylene glycol is also used as the additive adhered at the additive adhesion region 30. In addition, the additive may be same as additives of all of a plurality of the electrolytic plating cells, or may be same as additives of one or a plurality of the electrolytic plating cells. In this way, it will be operationally advantageous in cost, in operation, and in management.

Concentration of the additive is preferably same as concentration of additives in the electrolytic plating cells 20 and 40. For example, if concentration of additives in the electrolytic plating cells 20 and 40 is 2 mg/L, concentration of the additive adhered at the additive adhesion region 30 is also 2 mg/L. In addition, concentration of the additive may be same as concentration of additives of all of a plurality of the electrolytic plating cells, or may be same as concentration of additives of one or a plurality of the electrolytic plating cells. In this way, it will be more operationally advantageous in cost, in operation, and in management.

Even if additive component were different in the electrolytic plating cells 20 and 40, the additive adhered at the additive adhesion region 30 is preferably same as component of additive of one of the electrolytic plating cells 20 or 40. More preferably, component of the additive adhered at the additive adhesion region 30 is same as component of additive of latter electrolytic plating cell 40, in other words, it is same as component of additive in the electrolytic plating cell 40 after adhesion of the additive at the additive adhesion region 30.

In addition, even if concentration of additives were different in the electrolytic plating cells 20 and 40, concentration of the additive adhered at the additive adhesion region 30 is preferably same as concentration of additive of one of the electrolytic plating cells 20 or 40. More preferably, concentration of the additive adhered at the additive adhesion region 30 is same as concentration of additive of latter electrolytic plating cell 40, in other words, it is same as concentration of additive in the electrolytic plating cell 40 after adhesion of the additive at the additive adhesion region 30.

In FIG. 1, a device for performing the plating by carrying the work 11 to be plated horizontally is illustrated, but the plating may be performed by carrying the work 11 to be plated vertically. Likewise in vertical device and in horizontal device, there is a case that it is plated by separating the cells, so the additive is adhered between the electrolytic plating cells.

The amount of adhesion may be to the extent that the work 11 to be plated will be wetted by added solution, but the amount to the extent that the additive of the leveler, the brightener, and the carrier are adsorbed sufficiently on a surface of the work 11 to be plated, is preferable.

In addition, in a method for adhering the additive to the work to be plated, in a case of a horizontal device for carrying the work to be plated horizontally, it is preferable to adhere the additive directly to the work to be plated, by configuring additive adhesion nozzles 31 as sprays as in FIG. 1. In this way, it is possible to adhere the additive uniformly to the work to be plated. On the other hand, in a case of a vertical device for carrying the work to be plated vertically, the additive may be adhered directly to the work to be plated by sprays, or the work to be plated may be immersed in aqueous solution containing additive component. In this way, it is possible to adhere the additive uniformly to the work to be plated. And, it is possible to inhibit a decline of filling performance, and to maintain high filling property.

By configuring as the above filling plating system, it is possible to correspond to both horizontal device for carrying the work to be plated horizontally and vertical device for carrying the work to be plated vertically, and it is possible to correspond to various devices.

Figure 2B:
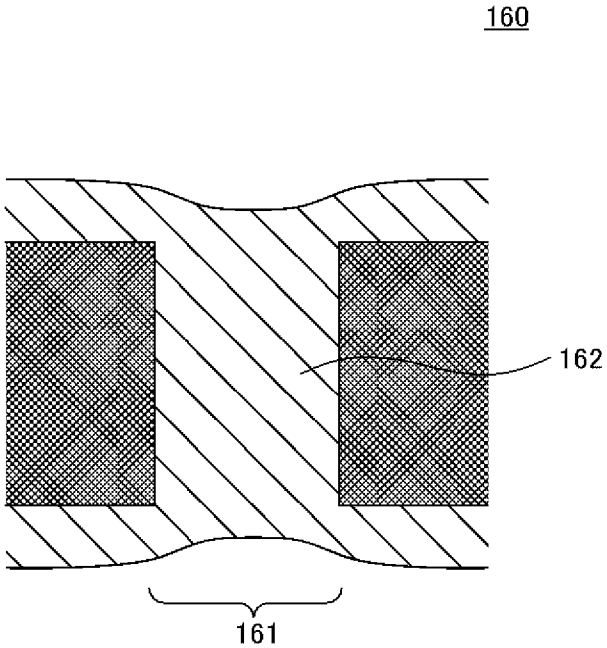
FIG. 2B is a sectional view illustrating a state after filling plating is formed in a through hole.
Figure 2A:
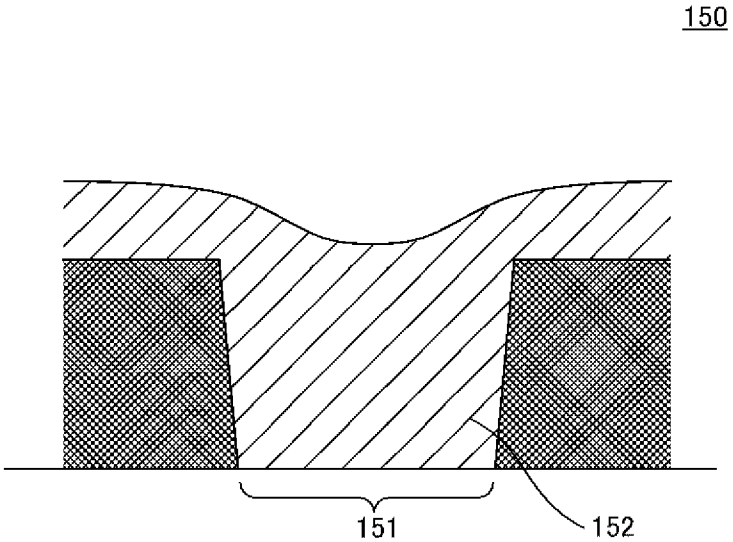
FIG. 2A is a sectional view illustrating a state after filling plating is formed in a via hole.

FIG. 2A is a sectional view illustrating a state after filling plating is formed in a via hole. As illustrated in a section 150 after forming filling plating in a via hole, filling plating is performed in a via hole 151, and via hole filling plating 152 is completed.

FIG. 2B is a sectional view illustrating a state after filling plating is formed in a through hole. As illustrated in a section 160 after forming filling plating in a through hole, filling plating is performed in a through hole 161, and through hole filling plating 162 is completed.

As mentioned above, the filling plating system relating to one embodiment of the present invention is capable of inhibiting a decline of filling performance, even in a case with the via hole 151 or the through hole 161 or that the via hole 151 and the through hole 161 are intermingled.

Figure 3:
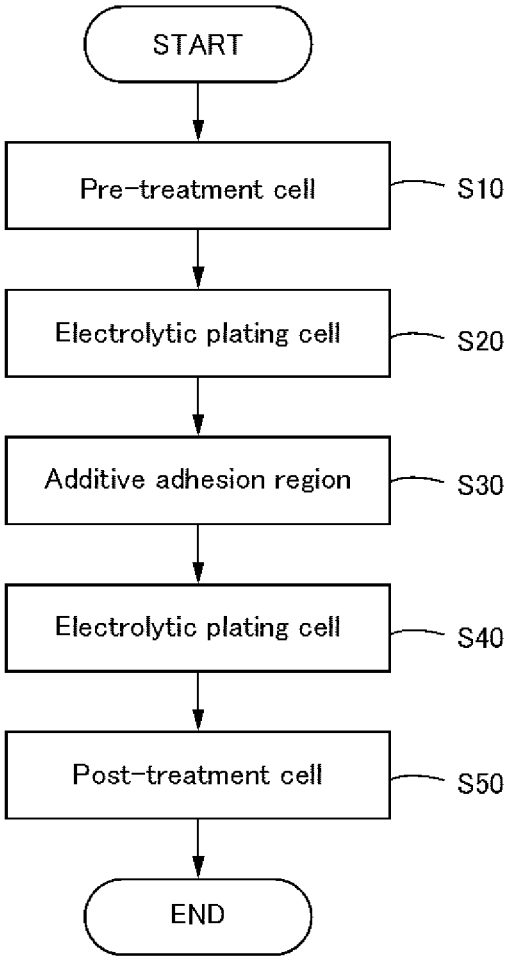
FIG. 3 is a flow chart schematically illustrating a filling plating method relating to one embodiment of the present invention.

Next, by using FIG. 3, explaining about a filling plating method relating to one embodiment of the present invention. FIG. 3 is a flow chart schematically illustrating a filling plating method relating to one embodiment of the present invention. As illustrated in FIG. 3, a pre-treatment similar to the treatment at the above pre-treatment cell is performed at a pre-treatment cell S10, and electrolytic plating is performed at an electrolytic plating cell S20.

And, before performing plating treatment at the following electrolytic plating cell S40, one or more kinds of additive selected from a leveler comprising at least nitrogen-containing organic compound, a brightener comprising sulfur-containing organic compound, and a carrier comprising polyether compound, is directly adhered to the work to be plated at the additive adhesion region S30. Then, in a post-treatment cell S50, necessary post-treatment, for example rust preventive treatment, water washing, drying, or the like is performed.

In this way, even when the plating is interrupted between electrolytic plating cells, it is possible to inhibit a decline of filling performance, and to maintain high filling property.

EXAMPLES

Next, explaining in detail about a filling plating system and a filling plating method relating to one embodiment of the present invention by examples. In addition, the present invention is not limited to these examples.

As a condition of a blank, an electrolytic plating cell was not separated, and plating was not interrupted. In addition, after performing chemical copper plating on a substrate comprising a via hole with an opening diameter of 90 μm and a depth of 80 μm, electrolytic copper plating was performed for 60 minutes at 1.5 A/dm$^2$. A condition of plating bath was 220 g/L of copper sulfate pentahydrate, 50 g/L of sulfuric acid, 40 mg/L chloride ion, 2 mg/L of bis-(3-sodium sulfopropyl) disulfide as a brightener, 200 mg/L of polyethylene glycol (mean molecular weight 10,000) as a carrier, 1 mg/L of Janus green B as a leveler, and plated with a jet stirring condition of 2 L/min at bath temperature of 25□.

Example 1

As example 1, electrolytic plating cells of the plating were separated and a number of interruption of the plating was one, and as a treatment of additive at an additive adhesion region (hereinafter referred to as treatment at the time of interruption of plating), Janus green B aqueous solution was adhered as a leveler. In addition, electrolytic copper plating, condition of plating bath, and jet stirring condition were same as the condition of the blank. In addition, a time of interruption per a plating was two minutes. Further, as a treatment before plating, additive of a leveler, a brightener, and a carrier was not adhered.

Example 2

As example 2, a number of interruptions of plating were 10, and as the treatment at the time of interruption of plating, bis-(3-sodium sulfopropyl) disulfide aqueous solution was adhered as a brightener. Other conditions were same as the example 1.

Example 3

As example 3, a number of interruptions of plating were 10 as the example 2, and as the treatment at the time of interruption of plating, polyethylene glycol (mean molecular weight 10,000) aqueous solution was adhered as a carrier. Other conditions were same as the example 1.

Example 4

As example 4, a number of interruptions of plating were 10 as the example 2, and as the treatment at the time of interruption of plating, Janus green B aqueous solution was adhered as a leveler. Other conditions were same as the example 1.

Comparative Example 1

As comparative example 1, a number of interruption of the plating was one, and as the treatment at the time of interruption of plating, ion exchanged water was adhered. Other conditions were same as the example 1.

Comparative Example 2

As comparative example 2. a number of interruptions of plating were 10, and as the treatment at the time of interruption of plating, ion exchanged water was adhered. Other conditions were same as the example 1.

Comparative Example 3

As comparative example 3. a number of interruptions of plating were 10 as the comparative example 2, and the treatment at the time of interruption of plating was to be left in air. Other conditions were same as the example 1.

Comparative Example 4

As comparative example 4. a number of interruptions of plating were 10 as the comparative example 2, and as the treatment before the plating, bis-(3-sodium sulfopropyl) disulfide aqueous solution was adhered as a brightener. In addition, as the treatment at the time of interruption of plating, ion exchanged water was adhered. Other conditions were same as the example 1.

Comparative Example 5

As comparative example 5. a number of interruptions of plating were 10 as the comparative example 2, and as the treatment before the plating, polyethylene glycol (mean molecular weight 10,000) aqueous solution was adhered as a carrier. In addition, as the treatment at the time of interruption of plating, ion exchanged water was adhered. Other conditions were same as the example 1.

Comparative Example 6

As comparative example 6. a number of interruptions of plating were 10 as the comparative example 2, and as the treatment before the plating, Janus green B aqueous solution was adhered as a leveler. In addition, as the treatment at the time of interruption of plating, ion exchanged water was adhered. Other conditions were same as the example 1.

Figure 4:
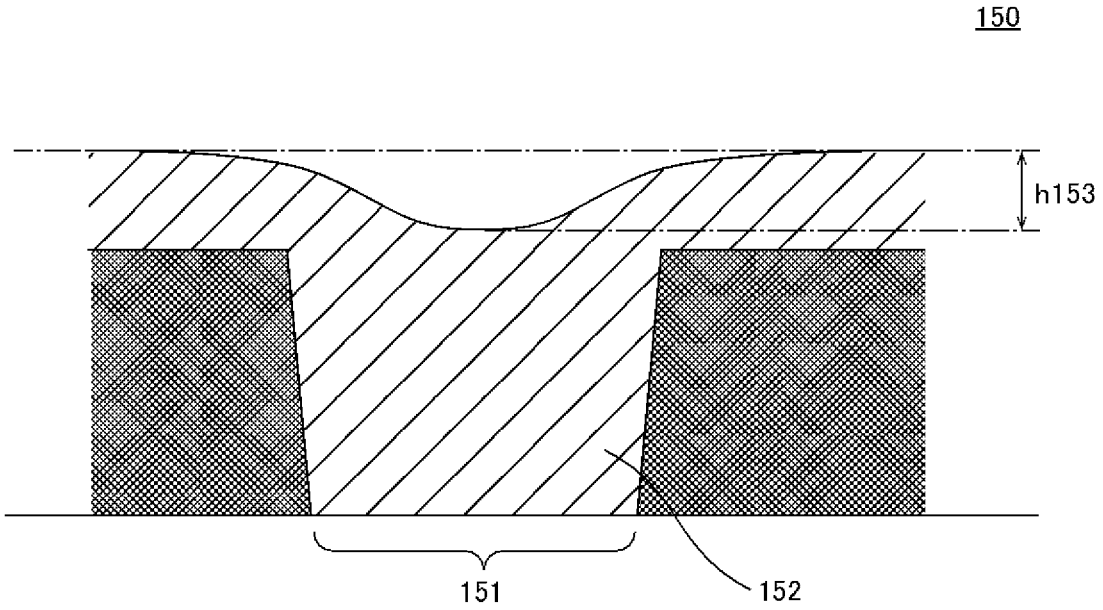
FIG. 4 is a sectional view illustrating a state after filling plating is formed in a via hole for explaining an amount of recess.

As illustrated in FIG. 4, after performing electrolytic copper plating in the blank, the examples 1 to 4, and the comparative examples 1 to 6, a recess h153 of via hole filling plating 152 plated in a via hole 151 was measured in a section 150 after forming filling plating in the via hole 151, using white light interference type microscope Contour GT-X made by BRUKER. In addition, appearance of a plating film was observed. Results thereof were shown in table 1.

TABLE 1

| | Condition | Treatment before plating | Treatment at the time of interruption of plating | Result | |
|---|---|---|---|---|---|
| | | | | Amount of recess (μm) | Appearance of plating film |
| — | Interruption of plating: No | — | — | 3 | Glossy |
| Example 1 | Interruption of plating: 1 | — | Janus green B aqueous solution is adhered as leveler | 3 | Glossy |
| Example 2 | Interruption of plating: 10 | — | Bis-(3-sodium sulfopropyl) disulfide aqueous solution is adhered as brightener | 5 | Glossy |
| Example 3 | Interruption of plating: 10 | — | Polyethylene glycol (mean molecular weight 10,000) aqueous solution is adhered as carrier | 6 | Glossy |
| Example 4 | Interruption of plating: 10 | — | Janus green B aqueous solution is adhered as leveler | 3 | Glossy |
| Comparative example 1 | Interruption of plating: 1 | — | Ion exchanged water is adhered | 12 | Glossy |
| Comparative example 2 | Interruption of plating: 10 | — | Ion exchanged water is adhered | 58 | White and cloudy |
| Comparative example 3 | Interruption of plating: 10 | — | Left in air | 72 | Rough, white and cloudy |
| Comparative example 4 | Interruption of plating: 10 | Bis-(3-sodium sulfopropyl) disulfide aqueous solution is adhered as brightener | Ion exchanged water is adhered | 60 | White and cloudy |
| Comparative example 5 | Interruption of plating: 10 | Polyethylene glycol (mean molecular weight 10,000) aqueous solution is adhered as carrier | Ion exchanged water is adhered | 56 | White and cloudy |
| Comparative example 6 | Interruption of plating: 10 | Janus green B aqueous solution is adhered as leveler | Ion exchanged water is adhered | 63 | White and cloudy |

As illustrated in table 1, an amount of recess of the plating in the blank was 3 μm. In addition, an amount of recess of the example 1, in which a number of interruption of plating was one, was also 3 μm. On the other hand, an amount of recess of the comparative example 1, in which the leveler was not adhered during the interruption of plating, was 12 μm. Therefore, it was possible to inhibit a decline of filling performance, and to maintain high filling property, even when the plating is interrupted, by adhering the leveler at the time of interruption of the plating.

In addition, an amount of recess of the examples 2, 3 and 4, in which a number of interruptions were 10, were respectively 5 μm, 6 μm and 3 μm. In addition, appearance of plating films was glossy. On the other hand, an amount of recess of the comparative examples 2 and 3 were respectively 58 μm and 72 μm, and they were large recesses. In addition, appearance of plating film in the comparative example 2 was white and cloudy, and appearance of plating film in the comparative example 3 was rough, white and cloudy. Therefore, by adhering the leveler at the time of interruption of the plating, it was possible to inhibit a decline of filling performance, and to maintain high filling property, and also, appearance of plating film was excellent, even when the plating was interrupted. In addition, from the above result, the effect to inhibit a decline of filling performance was significant, and the effect to appearance of plating film was also significant, as a number of interruptions of plating were increased.

In addition, by comparing the examples 2, 3 and 4, the example 4, to which the leveler was adhered at the time of interruption of the plating, was having the smallest amount of recess, and it was same amount as the amount of recess of the blank. Therefore, it was especially effective to adhere the leveler at the time of interruption of the plating.

In the comparative examples 4, 5 and 6, in which the electrolytic copper plating was performed by adhering the brightener, the carrier and the leveler at the treatment before plating, an amount of recesses were respectively 60 μm, 56 μm and 63 μm, and the amount of recesses were large. Therefore, it was not effective to perform electrolytic copper plating by adhering the additive at the treatment before plating. Thus, the examples, in which the additive such as the leveler was adhered at the time of interruption of the plating, were more effective as the effect to inhibit a decline of filling performance.

As mentioned above, by applying the filling plating system and the filling plating method relating to the present embodiment, it was possible to inhibit a decline of filling performance, and to maintain high filling property, even when the plating was interrupted between a plurality of electrolytic plating cells.

In addition, it is explained in detail about each embodiment and each example of the present invention as the above, but it can be understood easily for those who skilled in the art that various modifications are possible without practically departing from new matters and effect of the present invention. Therefore, all of such variants should be included in the scope of the present invention.

For example, terms described with different terms having broader or equivalent meaning at least once in description and drawings can be replaced with these different terms in any part of description and drawings. In addition, operation and configuration of the filling plating system and the filling plating method are not limited to those explained in each embodiment and each example of the present invention, and various modifications can be made.

GLOSSARY OF DRAWING REFERENCES

10 Pre-treatment cell
11 Work to be plated
12 Carrying roller
13 Spray nozzle
20 Electrolytic plating cell
21 Anode
22 Plating solution

30 Additive adhesion region
31 Additive adhesion nozzle
40 Electrolytic plating cell
50 Post-treatment cell
150 Section after forming filling plating in via hole
151 Via hole
152 Via hole filling plating
h153 Recess
160 Section after forming filling plating in through hole
20
161 Through hole
162 Through hole filling plating
S10 Pre-treatment cell
S20 Electrolytic plating cell
S30 Additive adhesion region
S40 Electrolytic plating cell
S50 Post-treatment cell

The invention claimed is:

1. A filling plating system for forming filling plating in a via hole and/or a through hole of a work to be plated, comprising:

a plurality of electrolytic plating cells;

an electrolytic bath comprising a solution for forming filling plating to the via hole or the through hole at one or more of the plurality of electrolytic plating cells, the solution comprising a leveler, a brightener and a carrier, an additive adhesion region, wherein after treatment at the one or more of the plurality of electrolytic plating cells, the work to be plated is carried to the additive adhesion region;

the additive adhesion region arranged between each of the plurality of electrolytic plating cells, the additive adhesion region comprising an additive solution including a leveler comprising nitrogen-containing organic compound, a brightener comprising sulfur-containing organic compound, and a carrier comprising a polyether compound, wherein the plurality of electrolytic plating cells and the additive adhesion region are horizontally arranged in series; and carrying rollers, wherein the work to be plated is carried continuously by the carrying rollers, and additive adhesion nozzles, further wherein the additive solution is directly adhered to the work to be plated at the additive adhesion region by the additive adhesion nozzles, and further wherein the additive solution adhered at the additive adhesion region does not contain a metal component that forms the filling plating.

2. The filling plating system according to claim 1, wherein the additive solution is directly adhered to the work to be plated in a non-energized state at the additive adhesion region.

3. The filling plating system according to claim 1, wherein components of a leveler, a brightener and a carrier of the additive solution are the same as the components of a leveler, a brightener and a carrier of filling plating solution in the one or more electrolytic plating cells.

4. The filling plating system according to claim 2, wherein a concentration of a leveler, a brightener and a carrier in the additive solution are the same as a concentration of a leveler, a brightener and a carrier in filling plating solution in the one or more electrolytic plating cells.

5. The filling plating system according to claim 1, wherein the plurality of electrolytic plating cells are devices to perform plating while carrying the work to be plated horizontally or vertically.

* * * * *